US010612419B2

(12) United States Patent
Terada et al.

(10) Patent No.: US 10,612,419 B2
(45) Date of Patent: Apr. 7, 2020

(54) STEAM TURBINE

(71) Applicant: MITSUBISHI HEAVY INDUSTRIES COMPRESSOR CORPORATION, Tokyo (JP)

(72) Inventors: Katsumi Terada, Hiroshima (JP); Hiroaki Irikawa, Hiroshima (JP); Yuichi Sasaki, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 43 days.

(21) Appl. No.: 16/065,675

(22) PCT Filed: Feb. 23, 2016

(86) PCT No.: PCT/JP2016/000945
§ 371 (c)(1),
(2) Date: Jun. 22, 2018

(87) PCT Pub. No.: WO2017/145190
PCT Pub. Date: Aug. 31, 2017

(65) Prior Publication Data

US 2019/0003338 A1 Jan. 3, 2019

(51) Int. Cl.
*F01D 25/24* (2006.01)
*F01D 9/04* (2006.01)

(52) U.S. Cl.
CPC ..... *F01D 25/246* (2013.01); *F01D 9/042* (2013.01); *F01D 25/24* (2013.01);
(Continued)

(58) Field of Classification Search
CPC ..... F01D 25/246
See application file for complete search history.

(56) References Cited

U.S. PATENT DOCUMENTS 3,300,180 A * 1/1967 Tuttle ..... F01D 9/041 415/138
7,645,117 B2 * 1/2010 Bracken ..... F01D 9/042 29/889.22

(Continued)

FOREIGN PATENT DOCUMENTS

EP 2206885 A1 7/2010
FR 2 929 983 A1 10/2009

(Continued)

OTHER PUBLICATIONS

Erosion Resistance, Stack et al. Tribocorrosion of Passive Metals and Coatings, 2011, retrieved from https://www.sciencedirect.com/topics/engineering/erosion-resistance.*

(Continued)

*Primary Examiner* — Woody A Lee, Jr.
(74) *Attorney, Agent, or Firm* — Osha Liang LLP

(57) ABSTRACT

A steam turbine includes: a stator vane disposed in a cylinder inside a casing through which steam flows from an upstream side toward a downstream side; and a stationary support that supports the stator vane relative to the casing. The stationary support includes: a first supporting body fixed to the casing, a second supporting body that connects the stator vane to the first supporting body; and a replacement body detachably disposed between the first supporting body and the second supporting body on the upstream side.

7 Claims, 4 Drawing Sheets

(52) U.S. Cl.
CPC ..... *F05D 2220/31* (2013.01); *F05D 2230/80* (2013.01); *F05D 2260/30* (2013.01); *F05D 2260/31* (2013.01)

(56) References Cited

U.S. PATENT DOCUMENTS

| | | | | |
|---|---|---|---|---|
| 9,086,078 | B2 * | 7/2015 | Nakayama | F01D 25/246 |
| 2006/0153683 | A1 | 7/2006 | Dube et al. | |
| 2007/0177973 | A1 * | 8/2007 | Seki | F01D 5/225 415/191 |
| 2012/0219412 | A1 | 8/2012 | Nakayama et al. | |
| 2013/0149125 | A1 | 6/2013 | Onishi et al. | |

FOREIGN PATENT DOCUMENTS

| | | | |
|---|---|---|---|
| JP | S58-146003 | U | 10/1983 |
| JP | S60-73806 | U | 5/1985 |
| JP | 2012-97601 | A | 5/2012 |
| JP | 2012-180748 | A | 9/2012 |
| JP | 2014-47668 | A | 3/2014 |

OTHER PUBLICATIONS

English translation of International Search Report on Patentability for corresponding International Application No. PCT/JP2016/000945, dated Sep. 7, 2018 (9 pages).

* cited by examiner

STEAM TURBINE

TECHNICAL FIELD

The present invention relates to a stationary component or stationary support of a steam turbine.

BACKGROUND

A stator vane that is a main constituent element of a stationary component provided inside a steam turbine is fixed to a casing that surrounds a cylinder of the steam turbine, through a partitioning plate.

Drain water droplets included in steam collide with the stationary component of the steam turbine, for example, the partitioning plate, at high speed during operation. Therefore, a phenomenon (erosion) in which the surface of the stationary component is shaved occurs, and may compromise the function as the stationary component if the phenomenon is neglected.

Further, if crack occurs on the surface of the stationary component due to erosion, the steam enters the crack to cause a phenomenon (corrosion) in which the stationary component is corroded.

Accordingly, maintenance and inspection work of periodically replacing the stationary component such as the partitioning plate is performed before failure occurs due to erosion and corrosion, but a burden of the work is large.

Accordingly, as disclosed in Patent Literature 1, erosion countermeasures in which a portion where erosion easily occurs is subjected to weld overlaying of stainless steel or is covered with Ni-based alloy through plasma splaying, have been proposed. This extends a period until replacement of the stationary component, which allows for reduction of the burden of the work.

CITATION LIST

Patent Literature 1: JP S60-73806 U

Even in a case where an erosion resistance layer is formed through the weld overlaying or coating by plasma, it is not possible to suppress occurrence of erosion when the steam turbine is used for a long time. Therefore, it is necessary to perform the maintenance and inspection work. To form the erosion resistance layer at the portion where erosion has occurred through the weld overlaying or plasma welding, however, it is necessary to convey the component to a place where a device necessary for formation of the erosion resistance layer is provided, and the burden of the work is accordingly large.

SUMMARY

Accordingly, one or more embodiments of the present invention provide a steam turbine including a stationary component (or stationary support) of the steam turbine that is easily replaced when erosion occurs.

A steam turbine according to one or more embodiments of the present invention includes a stator vane provided in a cylinder inside a casing through which steam flows from upstream side toward downstream side, and supporting means (or stationary support) configured to support the stator vane to the casing.

The supporting means includes a first supporting body fixed to the casing, a second supporting body connecting the stator vane and the first supporting body, and a replacement body detachably provided between the first supporting body and the second supporting body on the upstream side with reference to a flowing direction of the steam.

According to the steam turbine of one or more embodiments of the present invention, the replacement body can be provided at a region between the first supporting body and the second supporting body where erosion easily occurs. Therefore, it is possible to replace the replacement body on which erosion has occurred, with a new replacement body at necessary timing. In addition, according to one or more embodiments of the present invention, the replacement body is detachable. Therefore, it is possible to easily replace the replacement body with a new replacement body without movement to a place where special devices are provided.

The replacement body in one or more embodiments of the present invention includes a material having erosion resistance higher than erosion resistance of both of the first supporting body and the second supporting body.

This makes it possible to extend a period until the replacement body is replaced with a new one and to reduce replacement frequency.

The replacement body in accordance with one or more embodiments of the present invention may be detachably provided in an accommodating region (or accommodation region) provided in the second supporting body.

This makes it possible to easily dispose the replacement body at a desired position in a work of disposing the replacement body between the first supporting body and the second supporting body.

The replacement body in one or more embodiments of the present invention has a spigot structure in which an insertion end is inserted into a holding groove provided in the second supporting body, in the accommodating region.

As a result, the replacement body is easily positioned at a necessary position, and a position of the replacement body is easily maintained in replacement work.

The replacement body in one or more embodiments of the present invention is supported to the second supporting body by a restraining body that is detachably attached to the second supporting body.

This makes it possible to more surely support the replacement body to the second supporting body.

In accordance with one or more embodiments, one or both of the replacement body and the restraining body may be detachably attached by fastening means (or a fastener).

This allows one or both of the replacement body and the restraining body to be detachable, and makes it possible to simply and surely perform attachment of the replacement body to the second supporting body and attachment of the restraining body to the first supporting body.

In one or more embodiments, where a connection portion of the first supporting body and the second supporting body in the present invention has a structure in which the first supporting body is inserted into a recess provided in the second supporting body, the replacement body may be detachably provided between the first supporting body and the second supporting body inside the recess.

This makes it possible to support the replacement body also by the first supporting body.

The second supporting body in one or more embodiments of the present invention may include an upstream screen defining the recess from the upstream side, a downstream screen defining the recess from the downstream side, and a bottom floor defining the recess from a radial direction. In this case, the replacement body is detachably attached to the second supporting body by the restraining body that is detachably attached to the second supporting body. Further, the restraining body includes a fixed side to be fixed to the bottom floor, and a restraining side that is continuous to the fixed side and presses the replacement body against the upstream screen.

As a result, the replacement body is more surely supported to the second supporting body.

The second supporting body in one or more embodiments of the present invention may integrally include, at a part of the downstream screen, a flow guide that guides flow of the steam toward the downstream side.

This makes it possible to reduce manufacturing cost as compared with a case where the flow guide is individually provided.

In one or more embodiments of the present invention, the first supporting body and the second supporting body is connected to each other by fastening means between the downstream screen of the second supporting body and the first supporting body.

This allows for reduction of the burden of the maintenance and inspection work including replacement of the replacement body.

According to one or more embodiments of the present invention, the replacement body can be provided at the region between the first supporting body and the second supporting body where erosion easily occurs. Therefore, it is possible to replace the replacement body on which erosion has occurred, with a new replacement body at necessary timing. In addition, according to one or more embodiments of the present invention, the replacement body is detachable. Therefore, it is possible to easily replace the replacement body with a new replacement body without movement to a place where special devices are provided.

DETAILED DESCRIPTION

Figure 1:
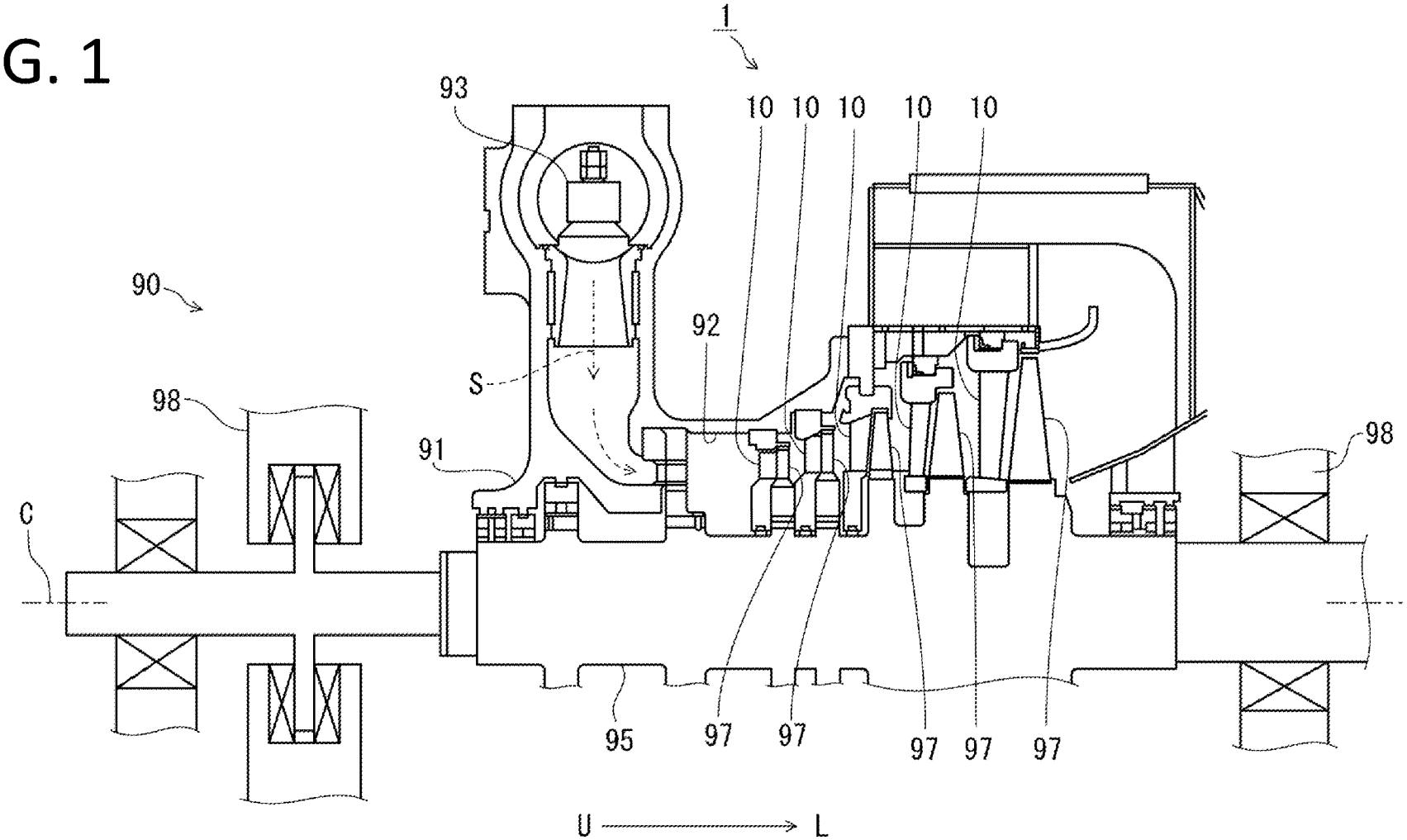
FIG. 1 is a cross-sectional side view illustrating a schematic configuration of a stationary component of a steam turbine according to one or more embodiments of the present invention.

A stationary component 1 of a steam turbine 90 according to one or more embodiments of the present invention is described below with reference to accompanying drawings. As illustrated in FIG. 1, the stationary component 1 of one or more embodiments of the present invention is disposed inside the steam turbine 90.

As illustrated in FIG. 1, and in accordance with one or more embodiments, the steam turbine 90 includes: a casing 91; a cylinder 92 that is air-tightly sealed by the casing 91; a regulation valve 93 that regulates an amount and pressure of steam S flowing into the cylinder 92; a turbine rotor 95 that is provided inside the casing 91 so as to be rotatable about a rotation axis C and transmits power to unillustrated machines such as a generator; and a plurality of bearing parts 98 that rotatably support the turbine rotor 95 about an axis. An inside of the cylinder 92 is formed to cause the steam S to flow from upstream side U to downstream side L. The pressure of the steam S is relatively higher on the upstream side U than on the downstream side L, and is gradually reduced toward the downstream side L.

Note that, in one or more embodiments, a direction orthogonal to a direction of the rotation axis C of the turbine rotor 95 is referred to as a radial direction, side close to the rotation axis C in the radial direction is referred to as inside in the radial direction, and side far from the rotation axis C in the radial direction is referred to as outside in the radial direction. Further, the upstream side U and the downstream side L of the flow of the steam S used in one or more embodiments indicate relative positional relationship.

The turbine rotor 95 accommodated in the cylinder 92 includes a shaft 96 and rotor blades 97 that are detachably provided on an outer peripheral surface of the shaft 96.

In one or more embodiments, the plurality of rotor blades 97 are provided from the upstream side U toward the downstream side L with predetermined intervals to form a rotor blade group. Each of the rotor blades 97 is provided so as to be continuous around the shaft 96 through attachment of half-cut segments to the shaft 96.

Further, stator vanes 10 that each extend from inner peripheral surface side of the casing 91 toward the center axis C of the shaft 96 are provided inside the cylinder 92.

The plurality of stator vanes 10 are provided from the upstream side U toward the downstream side L with predetermined intervals to configure a stator vane group, as with the rotor blades 97. Each of the stator vanes 10 is disposed on the upstream side U of the corresponding rotor blade 97 configuring the rotor blade group such that the stator vanes 10 and the rotor blades 97 are alternately disposed.

The stator vanes 10 are constituent elements of the stationary component 1. In one or more embodiments, a replacement body 30 described later is applied to each of two stator vanes 10 on the downstream side L among the plurality of stator vanes 10.

Figure 2:
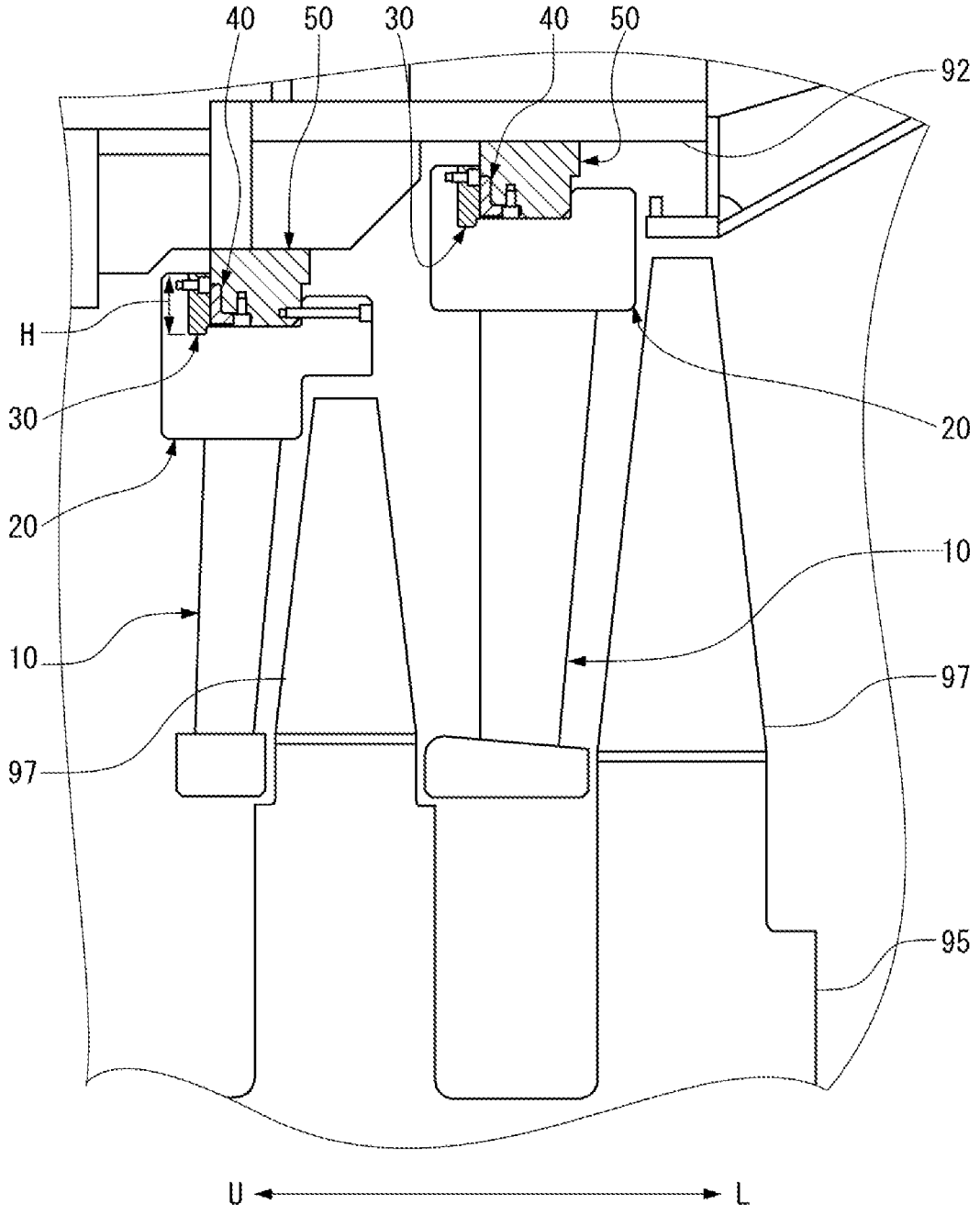
FIG. 2 is a partial enlarged view of FIG. 1.

As illustrated in FIG. 2, the stationary component 1 includes, as means to support each of the stator vanes 10, a partitioning body 20 to which a proximal end of the corresponding stator vane 10 is connected; the replacement body 30 that is detachably attached to the partitioning body 20; a restraining body 40 that detachably attaches the replacement body 30 to the partitioning body 20; and a supporting body 50 that has one end detachably coupled to the partitioning body 20 and the other end fixed to the inner peripheral surface of the casing 91, in addition to the above-described stator vanes 10. A second stationary component 1 from the downstream side L is described below as an example.

The partitioning body 20 corresponding to a second supporting body of one or more embodiments of the present invention is provided to secure flowing of the steam S from the upstream side U to the downstream side L through the rotor blades 97.

Figure 3:
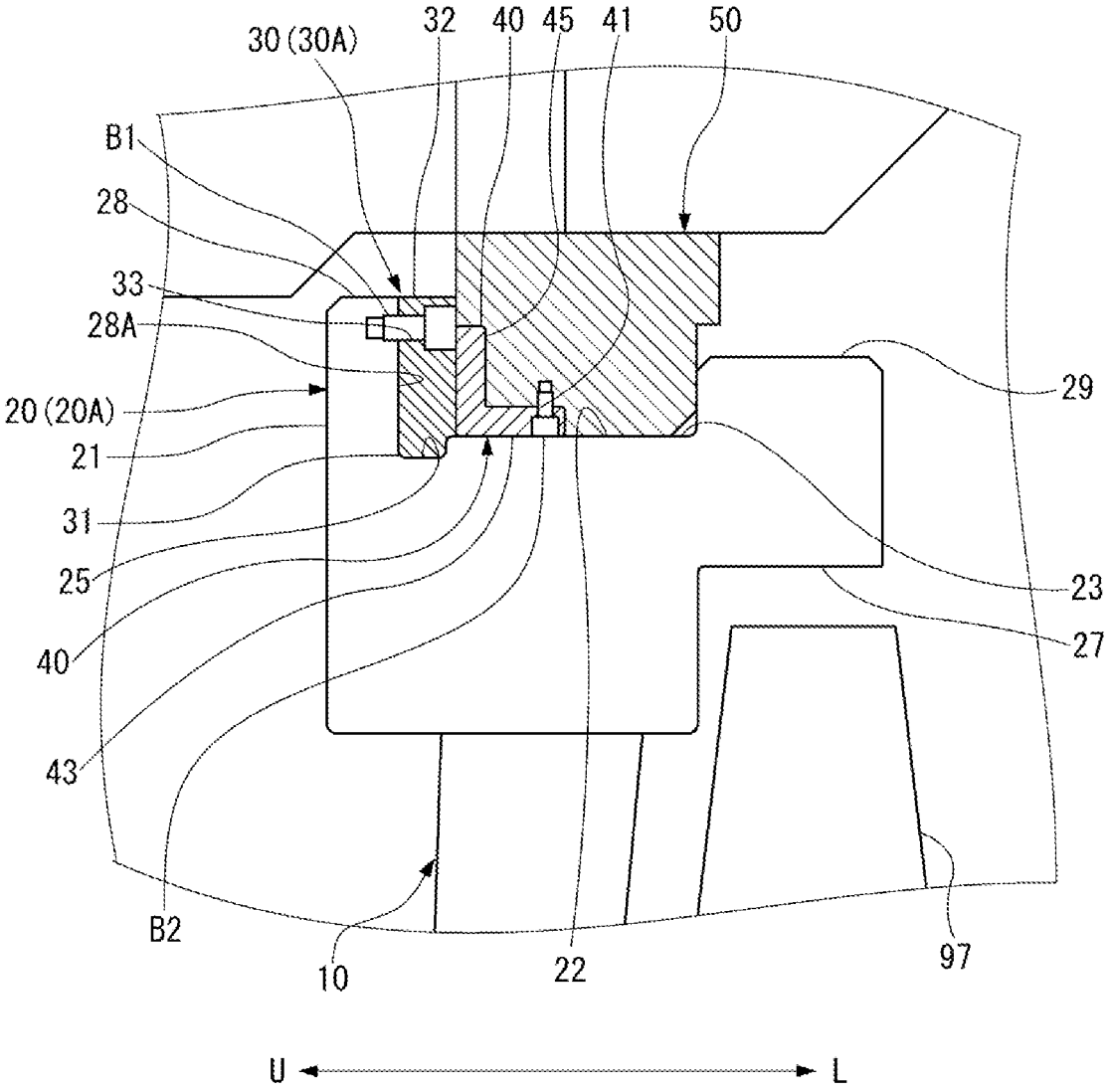
FIG. 3 is a partial enlarged view of FIG. 2.

The partitioning body 20 is provided continuously to the inner peripheral surface of the casing 91. The partitioning body 20, however, is made up of a combination of two segments 20A and 20B each having a half-cut shape because the partitioning body 20 is disposed around the corresponding stator vane 10. As illustrated in FIG. 3, a main body 21 of the partitioning body 20 includes a recess 22 as an accommodating region that accommodates a part of the supporting body 50. The main body 21 further includes an upstream screen 28, a downstream screen 29, and a bottom floor 23. The upstream screen 28 defines the recess 22 from the upstream side U, the downstream screen 29 defines the recess 22 from the downstream side L, and the bottom floor 23 defines the recess 22 from the radial direction. The recess 22, the bottom floor 23, the upstream screen 28, and the downstream screen 29 are continuous in a circumferential direction. This results in a spigot structure at a connection portion of the partitioning body 20 and the supporting body 50. Note that hatching of the partitioning body 20 is omitted in FIG. 3.

The bottom floor 23 of the recess 22 is formed in parallel to the rotation axis C. The bottom floor 23 includes a holding groove 25 that is a part of the bottom floor 23 on the upstream side receded inward in the radial direction relative to the other region. As illustrated in FIG. 3, the recess 22 accommodates the replacement body 30 in a region corresponding to the holding groove 25, and accommodates a part of the distal end side of the supporting body 50, on the downstream side L of the region.

Note that, although illustration is omitted in FIG. 3, the partitioning body 20 has a necessary gap between the bottom floor 23 and the distal end of the supporting body 50 in consideration of thermal elongation during operation of the steam turbine 90.

The upstream screen 28 supports the replacement body 30 described later from a side surface 28A facing the recess 22. A dimension of the upstream screen 28 projected from the bottom floor 23 toward the outside in the radial direction is made larger than that of the downstream screen 29, and a height thereof exceeds a half of the dimension of the supporting body 50 in the radial direction. The height of the partitioning body 20 is set in such a manner, which secures a region overlapped with the supporting body 50 in the radial direction to secure the support with respect to the rotation axis C.

The thickness of the inside of the downstream screen 29 in the radial direction is reduced, which causes a flow guide 27 to be integrally provided with the main body 21. The flow guide 27 guides the flow of the steam toward the downstream side, and is disposed so as to face the distal end of the corresponding rotor blade 97.

Next, the replacement body 30 is described.

In accordance with one or more embodiments, the replacement body 30 is a member that substitutes for a part of the partitioning body 20 at which erosion easily occurs. The replacement body 30 is detachably provided on the partitioning body 20 between the partitioning body 20 and the supporting body 50 on the upstream side with reference to the flowing direction of the steam S, which facilitates replacement work in maintenance and inspection.

Figure 4A:
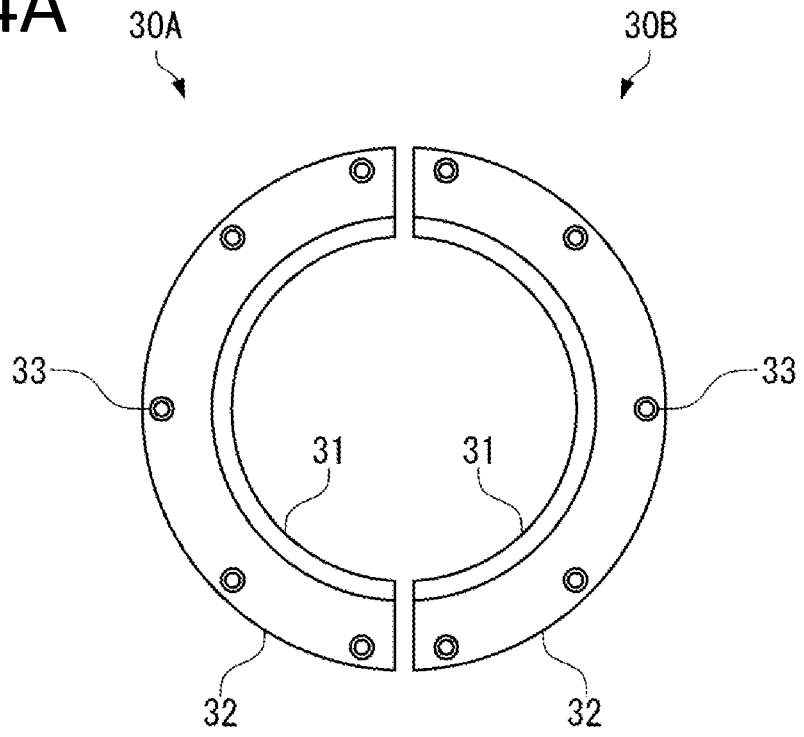
FIG. 4A is a plan view of two replacement bodies according to one or more embodiments.

As illustrated in FIG. 4A, the replacement body 30 has an annular shape to be continuous in the circumferential direction of the cylinder 92. The replacement body 30, however, is made up of a combination of two segments 30A and 30B each having a half-cut shape because the replacement body 30 is to be disposed around the partitioning body 20.

As illustrated in FIG. 2 and FIG. 3, the replacement body 30 has a rectangular cross-section, and a height H of the replacement body 30 from the bottom floor 23 when the replacement body 30 is disposed at a predetermined position of the partitioning body 20, is coincident with the height of the upstream screen 28. In other words, an outer diameter surface of the upstream screen 28 and an outer diameter surface of the replacement body 30 are made flush with each other with no step therebetween. This makes it possible to reduce staying of scale that causes erosion and corrosion.

The replacement body 30 has a predetermined thickness (dimension in rotation axis C direction) from the outer peripheral side toward the inner peripheral side, and includes an insertion end 31 having a small thickness on the innermost peripheral side, and an outer diameter surface 32 opposite to the insertion end 31. The thickness and a height (dimension in radial direction) of the insertion end 31 are set so as to be inserted into the holding groove 25 without a gap.

The replacement body 30 is fixed to the partitioning body 20 by bolts B1. The bolts B1 respectively penetrate through bolt holes 33 provided in the replacement body 30, and are fastened to the partitioning body 20. The dimensions of the respective bolts B1 and the dimensions of the respective bolt holes 33 are set in such a manner that, when the bolts B1 are each inserted up to a predetermined position for fixing the replacement body 30 to the partitioning body 20, heads of the respective bolts B1 are accommodated inside the replacement body 30, and only end faces of the respective bolts B1 are exposed from the replacement body 30. Note that a hexagon socket head bolt may be adopted as each of the bolts B1. The same applies to bolts B2.

As illustrated in FIG. 4A and in accordance with one or more embodiments, the plurality of bolts B1 and the plurality of bolt holes 33 are fastened with equal intervals in the circumferential direction. This contributes to improvement of adhesiveness between the replacement body 30 and the partitioning body 20. As a result, it is possible to prevent the steam S from flowing between the replacement body 30 and the partitioning body 20. Note that the fastening intervals may not be equal to one another as long as the adhesiveness between the replacement body 30 and the partitioning body 20 is secured.

When the replacement body 30 having the above-described configuration is fixed to the partitioning body 20 at the predetermined position at which the insertion end 31 is inserted into the holding groove 25, the outer diameter surface 32 is exposed inside the cylinder 92. Water droplets flowing from the upstream side U in the cylinder 92 in the stationary component 1 collide with the exposed outer diameter surface 32, and the collided water droplets are accumulated on the outer diameter surface 32.

In accordance with one or more embodiments, the replacement body 30 includes a material having wear resistance higher than wear resistance of both of the partitioning body 20 and the supporting body 50, namely, a material having high erosion resistance. As a result, a part of the replacement body 30 having wear resistance is exposed to a portion where erosion easily occurs, which makes it possible to effectively prevent occurrence of erosion.

The restraining body 40 fixes the replacement body 30 to the partitioning body 20.

Figure 4B:
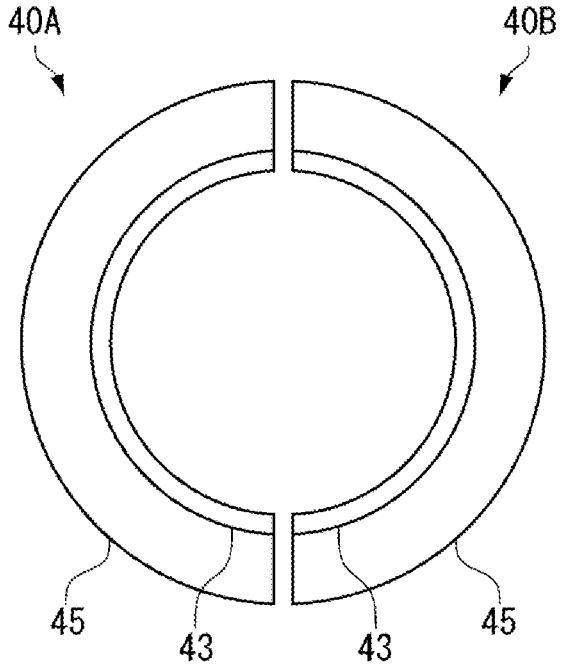
FIG. 4B is a plan view of two restraining bodies according to one or more embodiments.

As illustrated in FIG. 4B, the restraining body 40 has an annular shape to be continuous in the circumferential direction of the casing 91. The restraining body 40, however, is made up of a combination of two segments 40A and 40B each having a half-cut shape because the restraining body 40 is to be disposed around the partitioning body 20.

As illustrated in FIG. 3, the restraining body 40 has an L-shaped cross-section, and includes a fixed side 43 through which the restraining body 40 is fixed to the partitioning body 20, and a restraining side 45 that presses the replacement body 30 against the partitioning body 20.

When the fixed side 43 is fixed to the bottom floor 23 of the partitioning body 20, the restraining side 45 partially covers the heads of the respective bolts B1 fixing the replacement body 30. This makes it possible to prevent the bolts B1 fastening the replacement body 30 from falling off.

When the fixed side 43 of the restraining body 40 is fixed to the bottom floor 23, the restraining side 45 of the restraining body 40 presses the replacement body 30 against the upstream screen 28 of the partitioning body 20. This makes it possible to more surely support the replacement body 30 to the partitioning body 20, in addition to fastening of the replacement body 30 by the bolts B1.

A surface of the restraining side 45 and a surface of the fixed side 43 that come into contact with the supporting body 50, are formed such that a gap between the restraining body 40 and the supporting body 50 becomes minute when the restraining body 40 is inserted into a holding groove 51 of the supporting body 50.

Since the restraining body 40 according to one or more embodiments has the L-shaped cross-section, the restraining body 40 includes the fixed side 43 and the restraining side 45 with minimum cross-sectional area, namely, with a small amount of material.

The fixed side 43 of the restraining body 40 is fastened to the supporting body 50 by the bolts B2, and bolt holes 41 that penetrate through top and rear bottom surfaces of the fixed side 43 are accordingly provided on the fixed side 43 to communicate with the supporting body 50. The dimensions of the respective bolts B2 and the dimensions of the respective bolt holes 41 are set such that heads of the respective fastened bolts B2 are accommodated inside the fixed side 43 and only end faces of the respective bolts B2 are exposed from the fixed side 43. This makes it possible to minimize a gap between the supporting body 50 and the bottom floor 23 of the partitioning body 20.

According to one or more embodiments, the restraining body 40 may include a material same as or different from the material of the replacement body 30, or may include a material having high corrosion resistance.

The supporting body 50 supports the corresponding stator vane 10 through the partitioning body 20.

The supporting body 50 corresponding to a first supporting body of one or more embodiments of the present invention extends from the inner peripheral surface of the casing 91 toward a center axis of the turbine rotor 95, and has a semi-annular shape continuous in the circumferential direction of the casing 91. The holding groove 51 into which the restraining body 40 is to be inserted is provided on the side surface of the supporting body 50 on the upstream side U. Accordingly, even when the restraining body 40 is disposed between the supporting body 50 and the partitioning body 20, the gap between the supporting body 50 and the partitioning body 20 is minimized, which prevents the steam S from easily flowing into the gap.

The outer diameter surface of the supporting body 50 is fixed to the inner peripheral surface of the casing 91 through welding or other means, and the partitioning body 20 is fixed to the inner diameter surface of the supporting body 50. The supporting body 50 also has an annular shape but is made up of a combination of two members each having a half-cut shape.

The inner diameter side of the supporting body 50 is accommodated in the recess 22 of the partitioning body 20, and the supporting body 50 accordingly supports the partitioning body 20.

As for the stationary component 1 that includes the partitioning body 20, the replacement body 30, the restraining body 40, and the supporting body 50 described above, the partitioning body 20 is supported by the supporting body 50 while the inner diameter side of the supporting body 50 is accommodated in the recess 22 of the partitioning body 20. The replacement body 30 is fixed to the partitioning body 20 by the restraining body 40 fixed to the partitioning body 20 and fastening of the bolts B1 to the partitioning body 20. The restraining body 40 is interposed among the three members of the partitioning body 20, the replacement body 30, and the supporting body 50, and is not exposed to the outside.

According to one or more embodiments, stainless steel is used as the material of the replacement body 30 and the restraining body 40 described above. More specifically, martensitic stainless steel such as JIS SUS403 and JIS SUS410, or austenitic stainless steel such as JIS SUS304 and JIS SUS309 may be used.

Further, JIS SM400, JIS SN400, or the like may be used as the material of the partitioning body 20 and the supporting body 50.

Drain water droplets included in the steam S flowing into the cylinder 92 collide with the surface of each of the partitioning body 20, the replacement body 30, and the supporting body 50 constituting the stationary component 1 that are exposed inside the cylinder 92, during operation of the steam turbine 90. Even when the partitioning body 20, the replacement body 30, and the supporting body 50 are fabricated with use of a material excellent in corrosion resistance, if collision of the water droplets continues for a long time, corrosion may occur on the partitioning body 20, the replacement body 30, and the supporting body 50. Accordingly, maintenance and inspection work is performed on the stationary component 1.

The maintenance and inspection work is performed in the following manner.

First, each of the main bodies 21 and 21 each having the half-cut shape, of the partitioning body 20 are moved in a horizontal direction separating from the rotation axis C until the distal end of the supporting body 50 is drawn out of the recess 22 of the partitioning body 20. This separates the partitioning body 20 from the supporting body 50. As a result, the bolts B2 that fasten the restraining body 40 to the supporting body 50 are exposed. Therefore, to replace the restraining body 40 with a new one, the bolts B2 are removed and the restraining body 40 is removed from the supporting body 50.

On the other hand, the bolts B1, the respective heads of which are exposed to the outside, are removed from the partitioning body 20 separated from the supporting body 50, and then, the replacement body 30 used so far is removed. As described above, in one or more embodiments, it is possible to remove the used replacement body 30 from the partitioning body 20 through removal of the bolts B1.

Note that, before the work of separating the partitioning body 20 from the supporting body 50, the rotor blades 97 may be removed from the turbine rotor 95.

After the used replacement body 30 is removed, a new replacement body 30 separately prepared is disposed at the predetermined position at which the insertion end 31 is inserted into the holding groove 25 of the partitioning body 20. Next, the disposed replacement body 30 is fixed to the partitioning body 20 by the bolts B1. Thereafter, the partitioning body 20 is fixed to the supporting body 50 in a procedure reverse to the removing work, and the replacement work of the replacement body 30 is completed.

Effects achieved by the stationary component 1 of one or more embodiments are described below.

In the stationary component 1, since the part of the partitioning body 20 at which erosion easily occurs is replaced with the replacement body 30 that includes the material having corrosion resistance, it is possible to suppress occurrence of erosion. Therefore, according to one or more embodiments, it is possible to extend a period after the prior replacement body 30 is attached until the replacement body 30 is replaced with a new replacement body 30. Likewise, it is possible to extend a period until the restraining body 40 coming into contact with the replacement body 30 is replaced with a new restraining body 40.

Moreover, the replacement body 30 is detachably attached. Accordingly, even if erosion occurs on the replacement body 30, it is necessary to replace only the replacement body 30 and it is unnecessary to replace the partitioning body 20 as a whole. Therefore, it is possible to minimize the number of the members to be replaced, which makes it possible to suppress the cost of the maintenance and inspection work to be low. The same applies to the replacement work of the restraining body 40.

Furthermore, in one or more embodiments, replacement of the replacement body 30 is performed through attachment and detachment of the bolts. Therefore, the replacement work of the replacement body 30 is performable without movement in a special environment, which allows for reduction of the burden of the maintenance work.

The configurations described in the above-described embodiments may be selected or appropriately modified to other configurations without departing from the scope of the present invention.

For example, the replacement body 30 of one or more embodiments has the rectangular cross-section; however, the form of the replacement body is not limited thereto. The replacement body of one or more embodiments of the present invention is provided corresponding to erosion at the contact portion between the partitioning body 20 and the supporting body 50 on the upstream side U. Therefore, the form of the replacement body is optional as long as the replacement body is provided at such a region. For example, a replacement body having an L-shaped cross-section may be used.

The insertion end 31 of the replacement body 30 of one or more embodiments is inserted into the holding groove 25; however, the present invention is not limited to such a configuration. For example, a lower end part of the replacement body 30 may be simply placed on the flat bottom floor 23.

The replacement body 30 may be attached to the supporting body 50. Also in this case, the replacement body 30 is fixed to the supporting body 50 by the bolts. According to one or more embodiments, the bolts penetrate through the replacement body 30 and are fastened to the supporting body 50, and the heads of the respective bolts are accommodated inside the replacement body 30, as with the above-described embodiment. The outer diameter surface (32) of the replacement body 30 attached in such a manner is exposed inside the cylinder 92.

Note that, also in the case where the replacement body 30 is attached to the supporting body 50, a groove into which the replacement body 30 is to be inserted may be provided on the side surface of the upstream screen 28.

In addition, the part of the restraining side 45 of the restraining body 40 may be elongated to cover the distal end of the supporting body 50. This makes it possible to suppress occurrence of erosion at the distal end of the supporting body 50 and to reduce the burden of the work when the restraining body 40 is replaced due to occurrence of erosion.

Further, the shape of the cross-section of the restraining body 40 is not limited to the L-shape and the shape is optional as long as the restraining body 40 includes a restraining part and a fixed part. For example, the restraining body 40 may have a triangle cross-section or a rectangular cross-section.

In one or more embodiments, fastening by the bolts B1 and B2 is adopted as the attaching means of the replacement body 30 and the like. Alternatively, other methods that detachably attaches the replacement body 30 and the like may be adopted.

Furthermore, in one or more embodiments, both of the replacement body 30 and the restraining body 40 are detachably attached by the fastening means of the bolts. Alternatively, only one of the replacement body 30 and the restraining body 40 may be attached by the fastening means.

In one or more embodiments, the present invention is applied to the two stationary components 1 on the downstream side L; however, embodiments of the present invention may be applied to one or three or more stationary components 1 among the plurality of stationary components 1.

In addition, a recess may be provided on the supporting body 50 and a part to be inserted into the recess may be provided on the partitioning body 20.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Stationary component
10 Stator vane
20 Partitioning body
20A, 20B Segment
21 Main body
22 Recess
23 Bottom floor
25 Holding groove
27 Flow guide
28 Upstream screen
29 Downstream screen
30 Replacement body
30A, 30B Segment
31 Insertion end
32 Outer diameter surface
33 Bolt hole
40 Restraining body
40A, 40B Segment
41 Bolt hole
43 Fixed side
45 Restraining side
50 Supporting body
51 Holding groove
90 Steam turbine
91 Casing
92 Cylinder
93 Regulation valve
95 Turbine rotor
97 Rotor blade
98 Bearing part

The invention claimed is:

1. A steam turbine, comprising:

a stator vane disposed in a cylinder inside a casing through which steam flows from an upstream side toward a downstream side; and a stationary support that supports the stator vane relative to the casing, wherein the stationary support comprises:

a first supporting body fixed to the casing;

a second supporting body that connects the stator vane to the first supporting body; and a replacement body detachably disposed between the first supporting body and the second supporting body, on the upstream side with respect to the first supporting body, the first supporting body is inserted into a recess of the second supporting body, the replacement body is detachably disposed between the first supporting body and the second supporting body inside the recess, the second supporting body comprises:

an upstream screen that defines the recess on the upstream side;

a downstream screen that defines the recess on the downstream side; and a bottom floor that defines the recess in a radial direction, a restraining body is detachably attached to the first supporting body, the replacement body is detachably attached to the second supporting body by the restraining body, and the restraining body comprises:

a fixed side that is detachably fixed to the bottom floor; and a restraining side that is integrally connected to the fixed side and that presses the replacement body against the upstream screen.

2. The steam turbine according to claim 1, wherein the replacement body has an erosion resistance against water droplets included in the steam that is higher than that of both of the first supporting body and the second supporting body.

3. The steam turbine according to claim 1, wherein the replacement body is detachably disposed in an accommodation region of the second supporting body.

4. The steam turbine according to claim 3, wherein an insertion end of the replacement body is inserted into a holding groove of the second supporting body in the accommodation region.

5. The steam turbine according to claim 1, wherein one or both of the replacement body and the restraining body are detachably attached by a fastener.

6. The steam turbine according to claim 1, wherein the second supporting body further comprises, as an integral part of the downstream screen, a flow guide that guides flow of the steam toward the downstream side.

7. The steam turbine according to claim 1, wherein the first supporting body and the second supporting body are connected to each other by a fastener between the downstream screen of the second supporting body and the first supporting body.

* * * * *